US010493771B2

(12) United States Patent
Yoshigai et al.

(10) Patent No.: US 10,493,771 B2
(45) Date of Patent: Dec. 3, 2019

(54) DOT IMPACT PRINTING HEAD AND PRINTING APPARATUS

(71) Applicant: SEIKO EPSON CORPORATION, Tokyo (JP)

(72) Inventors: Hideaki Yoshigai, Nagano (JP); Takefumi Yamada, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/843,009

(22) Filed: Dec. 15, 2017

(65) Prior Publication Data

US 2018/0178544 A1 Jun. 28, 2018

(30) Foreign Application Priority Data

Dec. 27, 2016 (JP) ..... 2016-254251

(51) Int. Cl.
*B41J 2/255* (2006.01)

(52) U.S. Cl.
CPC ..... *B41J 2/255* (2013.01)

(58) Field of Classification Search
CPC ..... B41J 2/255; B41J 2/235
See application file for complete search history.

(56) References Cited

U.S. PATENT DOCUMENTS 5,237,918 A * 8/1993 Kobayashi ..... B41J 2/245 101/93.04
5,482,387 A * 1/1996 Tanuma ..... B41J 2/25 400/124.24
2002/0012557 A1* 1/2002 Terao ..... B41J 2/255 400/124.01
2003/0016982 A1* 1/2003 Horii ..... B41J 2/255 400/124.01

FOREIGN PATENT DOCUMENTS

JP 05-024213 A 2/1993

* cited by examiner

*Primary Examiner* — Shelby L Fidler
(74) *Attorney, Agent, or Firm* — Global IP Counselors, LLP

(57) ABSTRACT

A dot impact printing head for a printing apparatus that performs printing on a medium by repeating transport of the medium in a sub-scanning direction and movement of the dot impact printing head in a main scanning direction that intersects the sub-scanning direction, the dot impact printing head including at least one wire pin row formed as a result of a plurality of wire pins being arranged at a fixed pitch in the sub-scanning direction, in which all of the wire pins that configure the wire pin row are disposed shifted in three or more different positions in the main scanning direction within a range of the same dimension as the pitch.

12 Claims, 8 Drawing Sheets

DOT IMPACT PRINTING HEAD AND PRINTING APPARATUS

This application claims priority to Japanese Patent Application No. 2016-254251 filed on Dec. 27, 2016. The entire disclosure of Japanese Patent Application No. 2016-254251 is hereby incorporated herein by reference.

BACKGROUND

1. Technical Field

The present invention relates to a dot impact printing head and a printing apparatus.

2. Related Art

A dot impact printer, which is such a printing apparatus, is provided with a dot impact printing head (hereinafter, also simply referred to as a "printing head") for printing a character by striking a medium, such as pressure-sensitive paper, with a wire (wire pin) (for example, JP-A-5-24213). A dot impact printer adopts a serial printing system for printing a character on a medium by repeating movement of a printing head in a main scanning direction and transport of the medium in a sub-scanning direction.

For example, "OKI technical review" January 2007, #209, Vol. 74, No. 1, pp. 18-21 "Low-Noise SIDM Printer", [Retrieval Date: 30 Nov. 2016], The Internet, <https://www.oki.com/jp/Home/JIS/Books/KENKAI/n209/pdf/209_R05.pdf> indicates that there is a greater effect on noise reduction when printing using a dispersed impact pattern in which the character printing timing of a plurality of wires is dispersed than a simultaneous impact pattern in which the plurality of wires print a character simultaneously. Therefore, in addition to obtaining an effect of low-noise, devising a wire arrangement in which the frequency of dispersed impact character printing is enhanced is effective.

For example, JP-A-5-24213 discloses a printing head having an annular type wire arrangement in which a plurality of wires are arranged in an annular form.

However, in a printing apparatus provided with the printing head having the annular type wire arrangement disclosed in JP-A-5-24213, there is a problem in that it is likely that character printing shift will occur during variable speed printing that uses a variable speed process (an acceleration process and a deceleration process) of a printing head, and therefore, that there will be a decrease in printing quality. That is, in an annular type wire arrangement, since the movement speed (head movement speed) of the printing head during character printing driving changes slightly between wires in positions that are separated in the main scanning direction, character printing shift (dot shift) occurs as a result of the changes in the head movement speed. In recent years, due to demands for increased printing speed and improved printing quality, this kind of character printing shift can no longer be disregarded.

SUMMARY

An advantage of some aspects of the invention is to provide a dot impact printing head and a printing apparatus that are capable of obtaining a low-noise effect during printing and a suppressing effect of character printing shift between wire pins in a variable speed region of a dot impact printing head.

According to an aspect of the invention, there is provided a dot impact printing head for a printing apparatus that performs printing on a medium by repeating transport of the medium in a sub-scanning direction and movement of the dot impact printing head in a main scanning direction that intersects the sub-scanning direction, the dot impact printing head being provided with at least one wire pin row formed as a result of a plurality of wire pins being arranged at a fixed pitch in the sub-scanning direction, in which all of the wire pins that configure the wire pin row are disposed shifted in three or more different positions in the main scanning direction within a range of the same dimension as the pitch.

According to this configuration, since all of the wire pins that configure the wire pin row are disposed shifted in three or more different positions in the main scanning direction within a range of the same dimension as the pitch in the sub-scanning direction, the implemented frequency of dispersed impact character printing is relatively higher than those of configurations in which the wire pins are disposed in two different positions or are all disposed in the same position in the main scanning direction. Therefore, it is possible to obtain a low-noise effect during printing. Moreover, all of the wire pins that configure the wire pin row and are disposed shifted in three or more different positions are kept, in the main scanning direction, within the range of the same dimension as the pitch in the sub-scanning direction. Therefore, it is possible to restrict the amount of character printing shift (amount of dot shift) in which a character printing position in the main scanning direction shifts between wire pins in positions that are separated in the main scanning direction during variable speed printing in which printing is performed by using a variable speed process of at least one of an acceleration process and a deceleration process of the dot impact printing head. Accordingly, it is possible to obtain a low-noise effect during printing and a suppressing effect of character printing shift between wire pins during variable speed printing.

In the dot impact printing head, it is preferable that the number of the three or more different positions be less than the number of wire pins that configure the wire pin row.

According to this configuration, since the number of different positions in the main scanning direction of the wire pins is less than the number of wire pins, in comparison with a configuration in which all of the wire pins that configure the wire pin row are shifted in the main scanning direction in wire pin units, it is possible to dispose the wire pins in a dispersed manner leaving a broad center line interval in the main scanning direction in proportion to the breadth of a range within which all of the wire pins are kept in the main scanning direction. Accordingly, it is likely that noise during wire pin driving will be further decreased.

In the dot impact printing head, it is preferable that J (where J is a natural number of six or more) wire pins that configure the wire pin row include N (where N is a natural number satisfying $3 \leq N \leq J/2$) wire pin groups in the sub-scanning direction, and M (where M is a natural number satisfying $2 \leq M \leq J-4$) wire pins that belong to the wire pin groups be disposed in the same positions in the main scanning direction.

According to this configuration, since the positions in the main scanning direction are shifted in wire pin group units, in comparison with a configuration in which the positions are shifted in the main scanning direction in wire pin units, it is possible to dispose the wire pins in a dispersed manner leaving a broad center line interval in the main scanning direction in proportion to the breadth of a range within which all of the (J) wire pins are kept in the main scanning direction. Accordingly, it is more likely that noise during wire pin driving will be further decreased.

In the dot impact printing head, it is preferable that a plurality of the wire pin groups be disposed in a zigzag shape.

According to this configuration, as a result of a plurality of the wire pin groups being disposed in a zigzag shape, it is possible to dispose the wire pins in a dispersed manner leaving a broader center line interval in the main scanning direction in proportion to the breadth of a range within which all of the wire pins are kept in the main scanning direction. Accordingly, it is more likely that noise during wire pin driving will be further decreased. In addition, in a case in which all of the wire pins are disposed along an oblique direction that intersects the sub-scanning direction, for example, a case of character printing a character including an oblique line in which dots are aligned in an oblique manner, the frequency of simultaneous impact character printing is increased. In contrast to this, if a zigzag shape arrangement is used, the implemented frequency of dispersed impact is also increased in a case of character printing a character including such oblique lines. Accordingly, it is possible to obtain a low-noise effect during printing and a suppressing effect of character printing shift during variable speed printing.

In the dot impact printing head, it is preferable that the plurality of wire pins be disposed at a fixed pitch in the main scanning direction.

According to this configuration, in a case of determining, with reference to the character printing timing of, among a plurality of wire pins that configure the wire pin row, a wire pin that is positioned at the beginning in the traveling direction, character printing timings of other wire pins having different positions in the main scanning direction, a time interval of the character printing timing of each wire pin may be configured to be the same. Accordingly, character printing timing control is completed comparatively simply.

In the dot impact printing head, it is preferable that the printing apparatus perform constant speed printing that uses a constant speed process of the dot impact printing head, and variable speed printing that uses a variable speed process including at least one of an acceleration process and a deceleration process of the dot impact printing head.

According to this configuration, it is possible to restrict the amount of positional shift in the main scanning direction of printed dots between wire pins in positions that are separated in the main scanning direction during variable speed printing.

According to another aspect of the invention, there is provided a printing apparatus including the above-mentioned dot impact printing head, a main scanning section that causes the dot impact printing head to move in the main scanning direction, and a sub-scanning section that transports, in the sub-scanning direction, a medium that is the subject of printing of the dot impact printing head.

According to this configuration, since the printing apparatus is provided with the above-mentioned dot impact printing head, it is possible to obtain a similar functional effect to that of the above-mentioned dot impact printing head. Accordingly, it is possible to obtain a low-noise effect during printing and a suppressing effect of character printing shift between wire pins during variable speed printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a dot impact printing head and a dot impact printer, which is an example of a printing apparatus provided with the dot impact printing head, will be described with reference to the drawings. In each of the drawings below, the scales of each member, and the like, is altered from a practical scale in order to make each member, and the like, have a size that is easy to understand.

Figure 1:
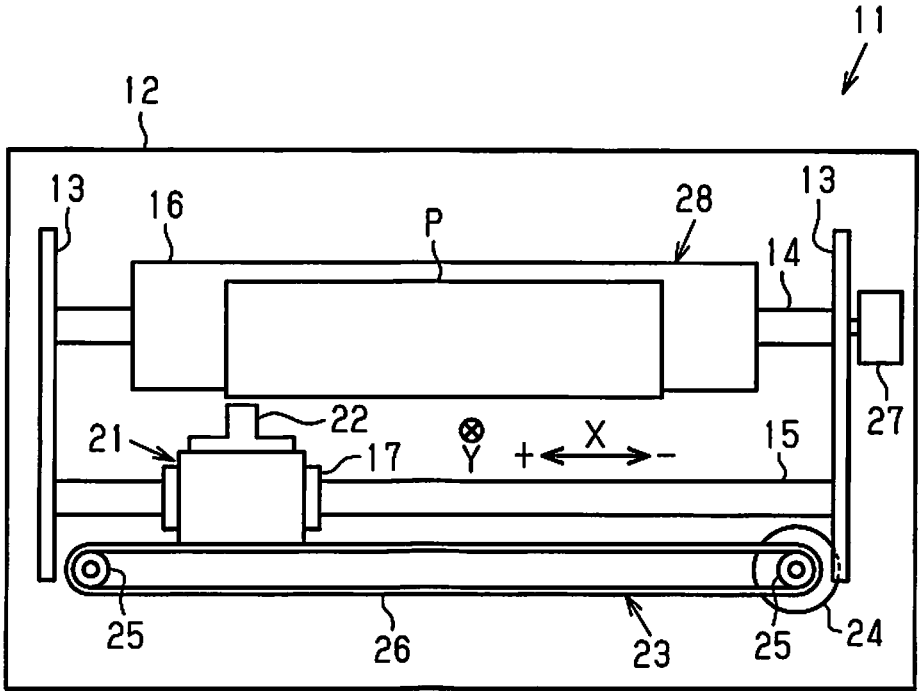
FIG. 1 is a cross-sectional view that shows a schematic configuration of a dot impact printer in an embodiment.

Firstly, a configuration of a dot impact printer will be described with reference to FIG. 1. A dot impact printer 11 (hereinafter, simply a "printer 11"), as an example of the printing apparatus shown in FIG. 1, is provided with a substantially rectangular parallelepiped housing 12, in which the left-right direction in the drawing is defined as the longitudinal direction thereof and a section of which is open toward the top (a direction that is orthogonal to the paper surface in FIG. 1). In the housing 12, a pair of frame members 13, which face one another, are disposed in both end sections in the longitudinal direction. A rotary shaft 14 and a guide shaft 15 are installed across the two frame members 13 in state of extending in parallel with one another in a state in which the axial directions thereof conform with one another in the longitudinal direction. The rotary shaft 14 is supported by the frame members 13 in a rotatable manner, and a cylindrical roller 16 (platen), which is long in the axial direction, is attached to the outer peripheral portions thereof other than both end sections. The roller 16 is capable of rotating together with the rotary shaft 14, and transports a medium P such as a sheet of paper by rotating, for example. That is, the roller 16 functions as a transport section that transports the medium P. The medium P is transported in a sub-scanning direction Y (a transport direction) in a state of being wound around the roller 16 as a result of the roller 16 rotating.

A carriage 17 that is capable of moving along the guide shaft 15 in a main scanning direction X, which intersects (specifically, is orthogonal to) the sub-scanning direction Y, is attached to the guide shaft 15. A dot impact printing head 21 (hereinafter also simply referred to as a "printing head 21") that prints (character prints) on the medium P is mounted on the carriage 17. A main scanning section 23 (movement mechanism) that causes the printing head 21 to move in the main scanning direction X is provided in the printer 11. In the present example, for example, a belt movement technique is adopted as the main scanning section 23. The main scanning section 23 is provided with a carriage motor 24 that acts as a drive source thereof, a pair of pulleys 25 that are capable of rotating due to the carriage motor 24, and an endless belt 26 that is wound around the pair of pulleys 25, and the carriage 17 is fixed to a section of the belt 26. As a result of the carriage motor 24 being driven to forward/reverse rotate, the printing head 21 reciprocates in the main scanning direction X along the guide shaft 15.

In addition, the printer 11 is provided with a sub-scanning section 28 (transport section) that transports the medium P in the sub-scanning direction Y. The sub-scanning section 28 is provided with the roller 16, which was mentioned earlier, and a transport motor 27, which is a drive source that drives the roller 16 in a rotational manner. The transport motor 27 is coupled in a power transmittable manner with the rotary shaft 14 of the roller 16 via a gear mechanism, which is not illustrated in the drawings. As a result of the roller 16 rotating due to driving of the transport motor 27, the medium P is transported in the sub-scanning direction Y in a state of facing the printing head 21.

The printing head 21 shown in FIG. 1 is provided with a nose section 22 that protrudes toward the roller 16. Further, the printing head 21 causes a wire pin 31 (refer to FIGS. 2 and 4) to protrude from the tip end of the nose section 22, which faces the roller 16, and prints a character on the medium P by striking the medium P with the wire pin 31. Such a printer 11 reproduces dots and prints a character and symbols on the medium P as a result of the wire pin 31 applying a pressure (a striking pressure) to the medium P via an ink ribbon, or the like. The printer 11 can print a character on the medium P without using an ink ribbon in a case in which pressure-sensitive paper such as carbonless paper is used as the medium P. Further, in a printer 11 that adopts a serial printing system, a transport operation, which transports the medium P in the sub-scanning direction Y by using the sub-scanning section 28 and a character printing operation, in which, while moving the printing head 21 in the main scanning direction X by using the main scanning section 23, the printing head 21 prints a character on the medium P supported by the roller 16 midway through the movement thereof, are repeated, and a document, or the like, is printed on the medium P on the basis of printing data. Additionally, in FIG. 1, the printing head 21 reciprocates in the main scanning direction X during printing, but the +X direction is defined as a forward direction (outward motion direction) and the −X direction is defined as a reverse direction (return motion direction).

Figure 2:
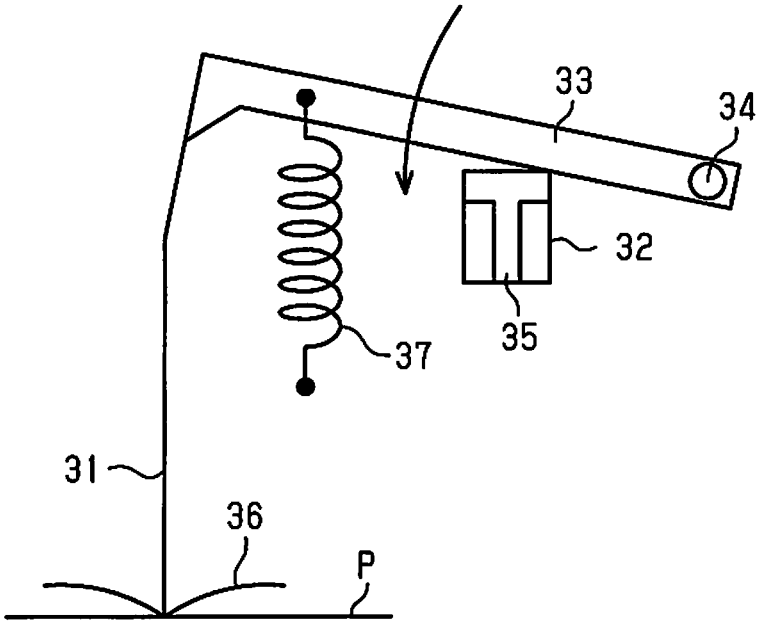
FIG. 2 is a schematic view that describes an impact operation of a printing head.
Figure 3:
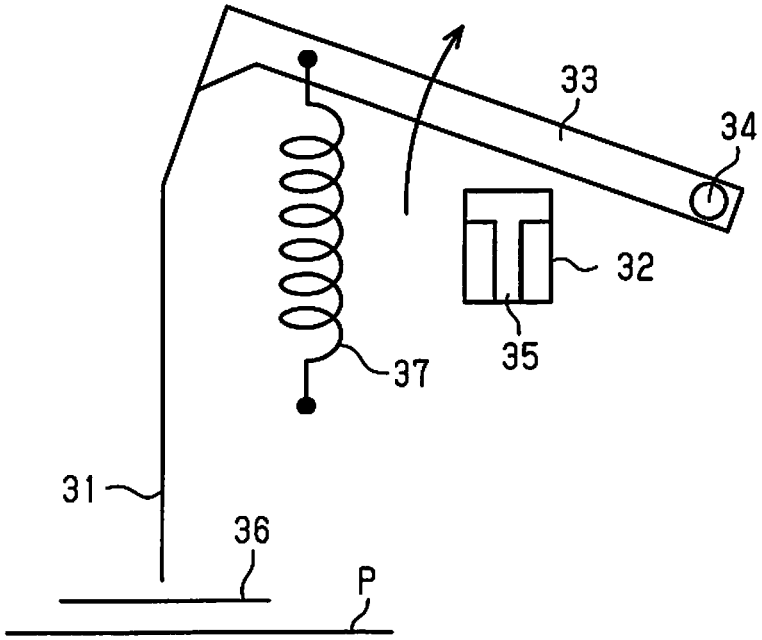
FIG. 3 is a schematic view that describes a return operation after the impact operation of the printing head.

FIG. 2 and FIG. 3 are explanatory views for describing an example of the character printing operation. FIG. 2 shows an operation that strikes the wire pin 31 against the medium P, and FIG. 3 shows an operation that separates the wire pin 31 from the medium P.

A magnetic force is generated when an electric current flows through a coil 32 in a case in which a character printing control signal output from a microcomputer becomes High and a switch (for example, a transistor; not illustrated in the drawings) in a control section 41 (refer to FIG. 6), which is built into the printer 11, is turned on. Further, as shown in FIG. 2, as a result of the generated magnetic force, a metallic lever 33 revolves in the direction shown by the arrow in the drawings with a shaft 34 as the center thereof, and is attracted to an iron core 35. Further, an image of dots is formed on the medium P, such as paper, as a result of the wire pin 31, which is connected to the lever 33, striking an ink ribbon 36 against the medium P. In addition, a case in which the medium P is pressure-sensitive paper, character printing is performed on the medium P as a result of directly striking the wire pin 31 against the medium P without using the ink ribbon 36.

Figure 4:
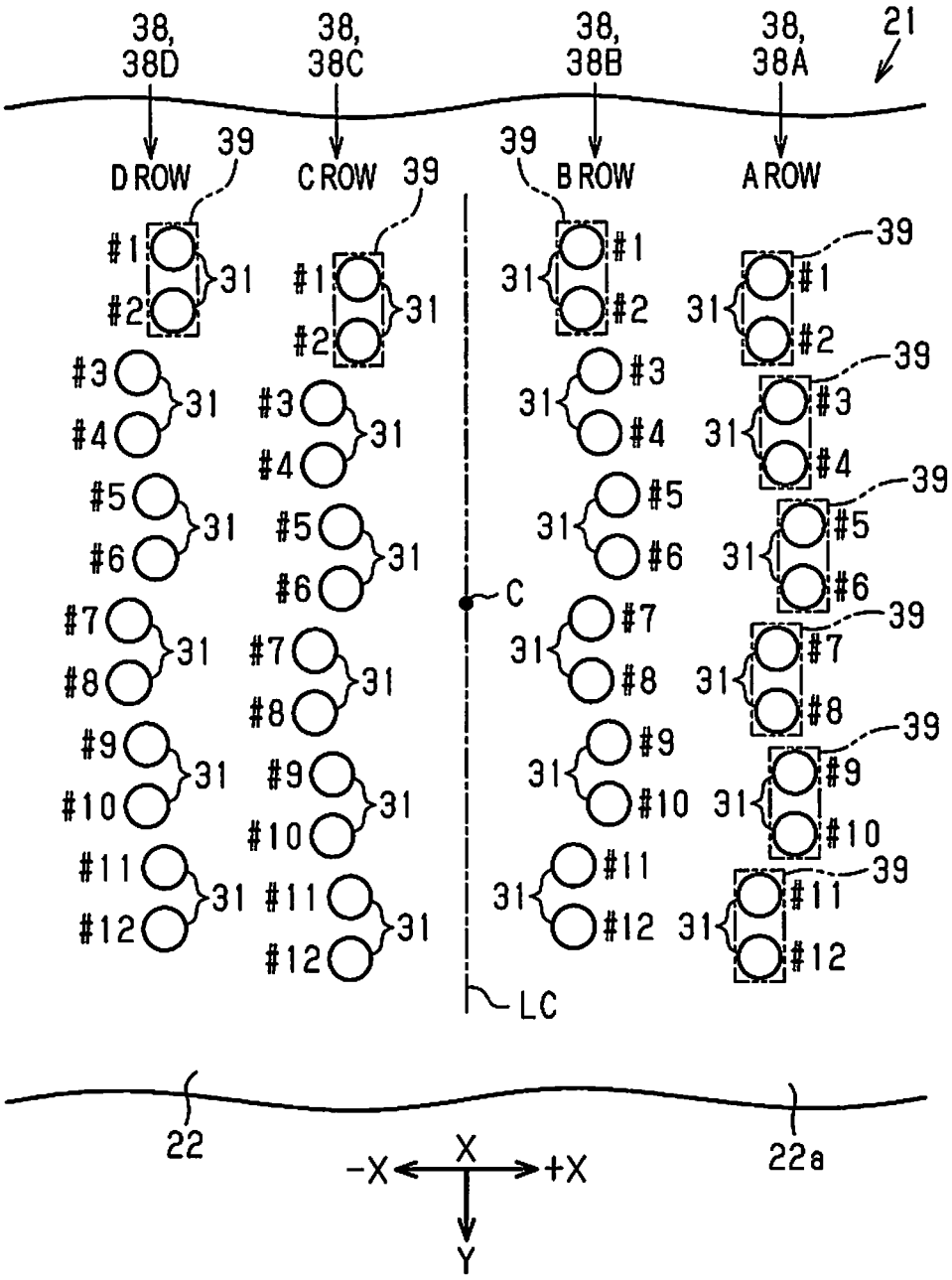
FIG. 4 is a front view that shows a wire pin row in the printing head.

In addition, as shown in FIG. 3, a return spring 37 pushes the lever 33 upward as shown by the arrow in the drawings, and biases the lever 33 in a direction of separating from the iron core 35. When the switch, which is not illustrated in the drawings, is turned off in accordance with the character printing control signal output from the microcomputer in the control section 41 and the current that flows through the coil 32 is interrupted, the magnetic force is no longer generated in the coil 32. Therefore, due to a biasing force of the return spring 37, the lever 33 revolves in a reverting direction that is shown by the arrow in FIG. 3 with the shaft 34 as the center thereof, and returns to the original position thereof. As a result of this, the wire pin 31 is also separated from the medium P and the ink ribbon 36 and returns to the original position thereof. Additionally, in FIGS. 2 and 3, only an operation of a single wire pin 31 is described, but a wire pin drive mechanism, which is composed of a coil 32, a lever 33, a return spring 37, and the like, for each of a plurality of wire pins 31 that are shown in FIG. 4, is provided, and each wire pin 31 is driven and controlled in an individual manner by the control section 41. Additionally, in the above-mentioned manner, in a case in which the medium P is pressure-sensitive paper, the printer 11 is used in a state in which the ink ribbon 36 has been detached.

Next, a wire pin row of the printing head will be described with reference to FIG. 4. As shown in FIG. 4, a plurality (K) of wire pin rows 38 are provided in a plate form wire guide 22*a*, which faces the surface of the roller 16, in the nose section 22 of the printing head 21. In the example shown in FIG. 4, four (for example, row A to row D) wire pin rows 38 are disposed in the wire guide 22*a*. In this instance, regarding the four wire pin rows 38 that are shown in FIG. 4, row A is defined as a first wire pin row 38A, row B is defined as a second wire pin row 38B, row C is defined as a third wire pin row 38C, and row D is defined as a fourth wire pin row 38D in order from the beginning in a traveling direction when the printing head 21 makes an outward motion. Additionally, in the following description, the term "wire pin row 38" will be used in cases in which it is not particularly necessary to distinguish between the wire pin rows 38A to 38D.

The wire pin row 38 includes a plurality (J (where J is a natural number (12 in the present example) satisfying J≥4)) of wire pins 31 that are disposed at a fixed pitch Yp in the sub-scanning direction Y. The J wire pins 31 that configure each wire pin row 38 are arranged so that, for example, the pitch Yp in the sub-scanning direction Y is equal to 1/72 inch. Additionally, the pitch Yp in the sub-scanning direction Y of the wire pins 31 can be altered in accordance with a desired print resolution, and for example, may be 1/36 inch, or 1/144 inch.

In this instance, the symbols #1 to #12 are respectively allocated to the J (12 in the present example) wire pins 31 that configure a wire pin row 38. The four wire pin rows 38 shown in FIG. 4 are disposed in a central section of the surface of the wire guide 22*a*. In FIG. 4, a number of the wire pins 31 corresponding to four rows (a total of 48), which configure four wire pin rows 38, take on an arrangement pattern that corresponds to a positional relationship corresponding to point symmetry relative to a center point C of a center line Lc in the main scanning direction X of the wire guide 22*a* (or the four wire pin rows 38). That is, as shown in FIG. 4, the J wire pins 31 that configure the first wire pin row 38A (row A) and the J wire pins 31 that configure the fourth wire pin row 38D (row D) take on an arrangement pattern corresponding to point symmetry with one another relative to the center point C. In addition, the J wire pins 31 that configure the second wire pin row 38B (row B) and the J wire pins 31 that configure the third wire pin row 38C (row C) take on an arrangement pattern corresponding to point symmetry with one another relative to the center point C.

In FIG. 4, for example, it is possible to print a character one kanji character by using the first wire pin row 38A and the second wire pin row 38B, and for example, it is possible to print one kanji character by using the third wire pin row 38C and the fourth wire pin row 38D. In the printing head 21 of the present embodiment, high speed character printing is possible since character printing of two characters at a time is possible. In two-row sets of wire pin rows 38A and 38B, and 38C and 38D, which are capable of character printing one character, the portions that form a set have the same arrangement pattern, and the positions of the wire pins 31 in the sub-scanning direction Y are shifted between the wire pin rows 38 by half pitch (=Yp/2). Therefore, it is possible to print one character at a resolution of 144 dpi by using two first wire pin row 38A and 38B, and 38C and 38D at a time. Additionally, in the present example that uses two wire pin rows 38 in character printing of one character, the print resolution is 72 dpi when the pitch Yp is 1/36, and the print resolution is 288 dpi when the pitch Yp is 1/144.

Figure 5:
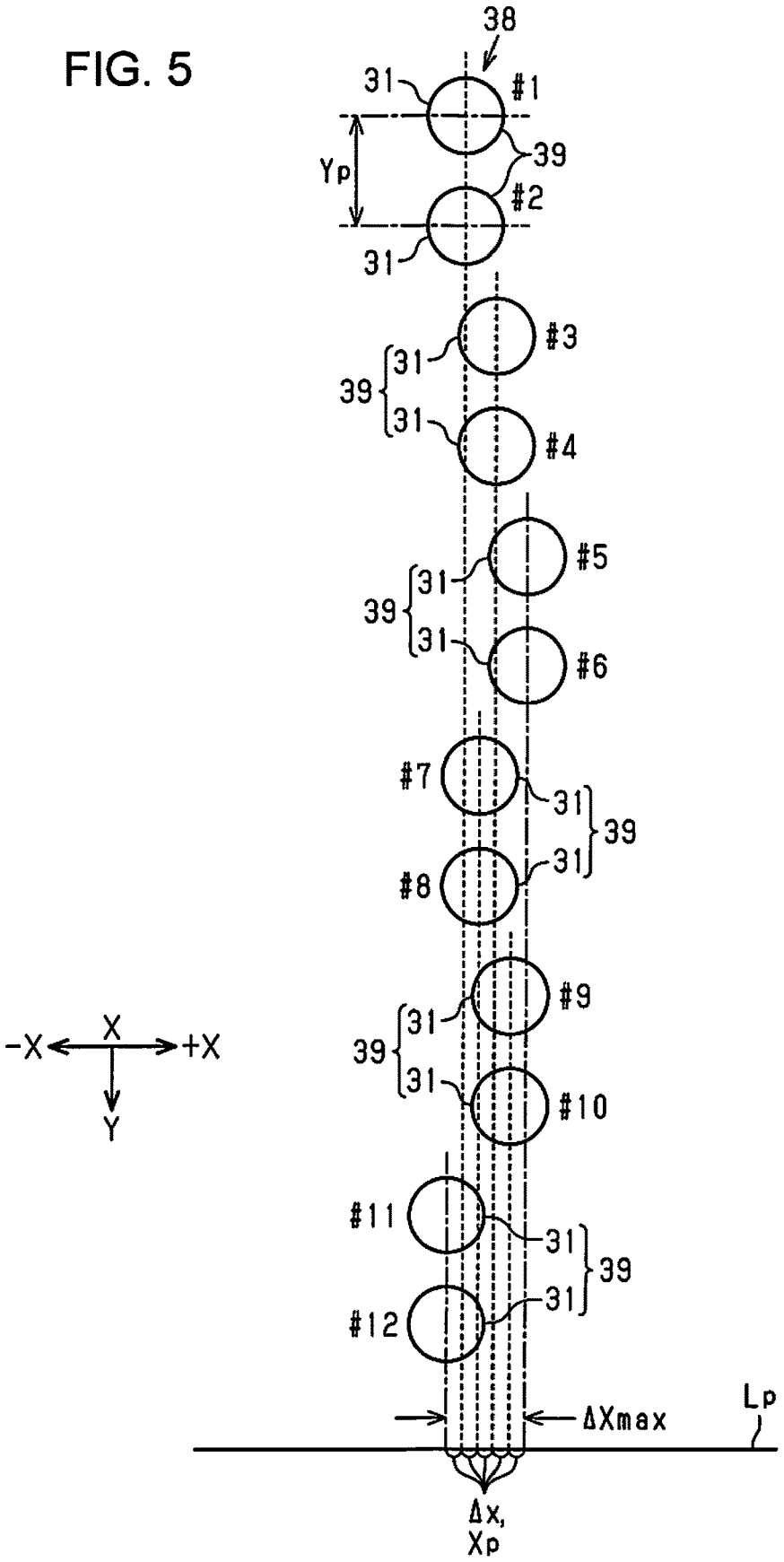
FIG. 5 is a front view that describes features of the wire pin row.

As shown in FIGS. 4 and 5, in the present embodiment, the plurality (J) of wire pins 31 that configure a wire pin row 38 are disposed shifted in three or more different positions in the main scanning direction X. In particular, in the present example, J is a natural number of six or more, and the J (12) wire pins 31 include N (where N is a natural number satisfying $3 \leq N \leq J/2$) wire pin groups 39. M (where M is a natural number satisfying $2 \leq M \leq J-4$) wire pins 31 that belong to a wire pin group 39 are disposed in the same position in the main scanning direction X. In FIGS. 4 and 5, the number M of wire pins 31 that belong to a wire pin group 39 is M=2 across all of the wire pin groups 39, but as long as the condition of $2 \leq M \leq J-4$ is satisfied, wire pin groups 39 respectively having different wire pin numbers M that belong thereto may be mixed in a wire pin row 38.

In addition, in the present example, in particular, N is four or more ($N \geq 4$), and N wire pin groups 39 are disposed in a zigzag shape positioned shifted in four or more (for example, six) different positions. In the present example, the N wire pin groups 39 have mutually different positions in the main scanning direction X. As a result of the N wire pin groups 39 being disposed in a zigzag shape, the J wire pins 31 that belong thereto are disposed in the same zigzag shape, and are disposed shifted in four or more (for example, six) different positions in the main scanning direction X. In the present example, the number of different positions in which the J wire pins 31 are disposed in the main scanning direction X is equal to the number N (six in the present example), which is equivalent to the number of wire pin groups 39. Additionally, in FIG. 4, all (six) of the wire pin groups 39 that belong to the first wire pin row 38A (row A) are shown surrounded by dashed-two dotted rectangles, but for the other wire pin rows 38B to 38D, only a first wire pin group 39, which includes wire pins #1 and #2 is shown surrounded by a dashed-two dotted line, and display of the other wire pin groups is omitted.

As shown in FIG. 5, all (J) of the wire pins 31 that configure a wire pin row 38 are disposed shifted in three or more (in particular, six in the present example) different positions in the main scanning direction X within a range of the same dimension as the pitch Yp (center line interval) in the sub-scanning direction Y of the wire pin 31. In other words, the J wire pins 31 are disposed shifted in three or more (in particular, six in the present example) different positions in the main scanning direction X, and a maximum amount of shift ΔX max in the main scanning direction X is equal to the dimension of the pitch Yp in the sub-scanning direction Y of the wire pin 31 or less. That is, the maximum amount of shift ΔX max satisfies the condition $\Delta X\ max \leq Yp$. In this instance, the maximum amount of shift ΔX max indicates the center distance between, among the J wire pins that configure a wire pin row 38, a wire pin 31 that is positioned furthest on the −X direction side and a wire pin 31 that is positioned furthest on the +X direction side.

In addition, in the present example, the dimension of a range in which the J wire pins 31 are disposed shifted in three or more (in particular, six in the present example) different positions, that is, of the maximum amount of shift ΔX max is equal to the radius of the wire pins 31 or more. In particular, in the present example, the dimension of the maximum amount of shift ΔX max is equal to the diameter of the wire pins 31 or more. The implemented frequency of dispersed impact character printing increases in tandem with an increase in the maximum amount of shift ΔX max and a decrease in the number of the three or more different positions of the wire pins 31 in the main scanning direction X. Therefore, the maximum amount of shift ΔX max and the number of the three or more different positions of the wire pins 31 may be determined in order to obtain a desired implemented frequency of dispersed impact character printing. Additionally, the arrangement of the wire pins 31 is determined by the arrangement of guide holes, which are opened in the wire guide 22*a* but are not illustrated in the drawings. In this instance, although description will be given focusing on the wire pins 31, since the arrangement of the wire pins 31 and arrangement of the guide holes coincide with one another, it is possible to interpret the arrangement of the wire pins 31 as the arrangement of the guide holes.

In the example that is shown in FIGS. 4 and 5, the J wire pins 31 are disposed in the main scanning direction X in N different positions within a range in which the maximum amount of shift ΔX max is a dimension that is the same as the pitch Yp in the sub-scanning direction Y by shifting the N wire pin groups 39 that configure a wire pin row 38 into three or more different positions in the main scanning direction X. Therefore, according to the present embodiment, which adopts the wire pin arrangement shown in FIG. 5, in comparison with a configuration in which all of the J wire pins are shifted into J different positions in the main scanning direction X, it is possible to ensure relatively large amounts of shift Δx, which are the center line intervals of the wire pins 31 in the main scanning direction X. As shown in FIG. 5, in a case in which the J (12) wire pins 31 that are disposed in a zigzag shape are projected in the sub-scanning direction Y relative to a projection line Lp, which is orthogonal to the sub-scanning direction Y, the amounts of shift Δx in the main scanning direction X of the N (six) projected wire pins on the projection line Lp are all equivalent to one another. In other words, the J wire pins 31 are disposed at a fixed pitch Xp in the main scanning direction X.

Next, the character printing operation that is performed by causing the printing head 21 to move in the main scanning direction X will be described. During character printing on the medium P, the printing head 21 performs character printing while moving in the main scanning direction X. At this time, for example, when moving (making an outward motion) in the forward direction +X, the printing head 21 prints a character by respectively driving the J (12) wire pins 31 in order from the wire pin 31 on the tip end side in the traveling direction during outward motion for each of the wire pin rows 38A to 38D. In addition, when moving (makes a return motion) in the reverse direction −X, the printing head 21 prints a character by respectively driving the J wire pins 31 in order from the wire pin 31 on the tip end side in the traveling direction during return motion for each of the wire pin rows 38A to 38D.

In particular, in the printing head 21 of the present embodiment, which includes the plurality of wire pin groups 39, as shown in FIG. 4, when the printing head 21 moves in the forward direction +X, in the K (four) wire pin rows 38A to 38D, the N wire pin groups 39 that respectively belong thereto are controlled so as to be driven in order from the wire pin group 39 that is positioned on the tip end side in the traveling direction. More specifically, the J (12) wire pins 31 that configure the first wire pin row 38A are struck in a sequence of the wire pins #5 and #6 first, the wire pins #9 and #10 second, the wire pins #3 and #4 third, the wire pins #7 and #8 fourth, the wire pins #1 and #2 fifth, and the wire pins #11 and #12 sixth. Next, the wire pins #1 to #12 that configure the second wire pin row 38B are struck in a similar sequence to that of the first wire pin row 38A. Furthermore, the wire pins 31 that configure the third wire pin row 38C are struck in an order of the wire pins #1 and #2 first, the wire pins #11 and #12 second, the wire pins #5 and #6 third, the wire pins #9 and #10 fourth, the wire pins #3 and #4 fifth, and the wire pins #7 and #8 sixth. Next, the wire pins #1 to #12 that configure the fourth wire pin row 38D are struck in a similar order to that of the third wire pin row 38C.

Meanwhile, when the printing head 21 moves (makes a return motion) in the reverse direction −X, the N wire pin groups 39 that respectively belong to the K (four) wire pin rows 38A to 38D are controlled so as to be driven in order from the wire pin group 39 that is positioned on the tip end side in the traveling direction. More specifically, when the printing head 21 moves in the reverse direction −X, the wire pin groups 39 that configure the K wire pin rows 38A to 38D are driven in the reverse sequence to the sequence during the forward direction +X. Additionally, the printing head 21 forms dots by striking a total of K rows×J wire pins 31, which configure each wire pin row 38A to 38D, against the medium P in mutually different positions in the main scanning direction X and the sub-scanning direction Y. In addition, characters are character printed as a result of, among the K rows×J wire pins 31, wire pins selected on the basis of printing data PD being struck and driven.

Next, an electrical configuration of the printer 11 will be described with reference to FIG. 6. The printer 11 is provided with the control section 41, which manages control of the printer 11, the printing head 21, the carriage motor 24, the transport motor 27, and an encoder 29. The encoder 29 detects rotation of the carriage motor 24 or rotation of a power transmission system (for example, gears) of the main scanning section 23, and outputs a rotation detection signal (an encoder signal), which includes a number of pulses that is proportionate to the amount of movement (movement distance) of the carriage 17, to the control section 41.

Figure 7:
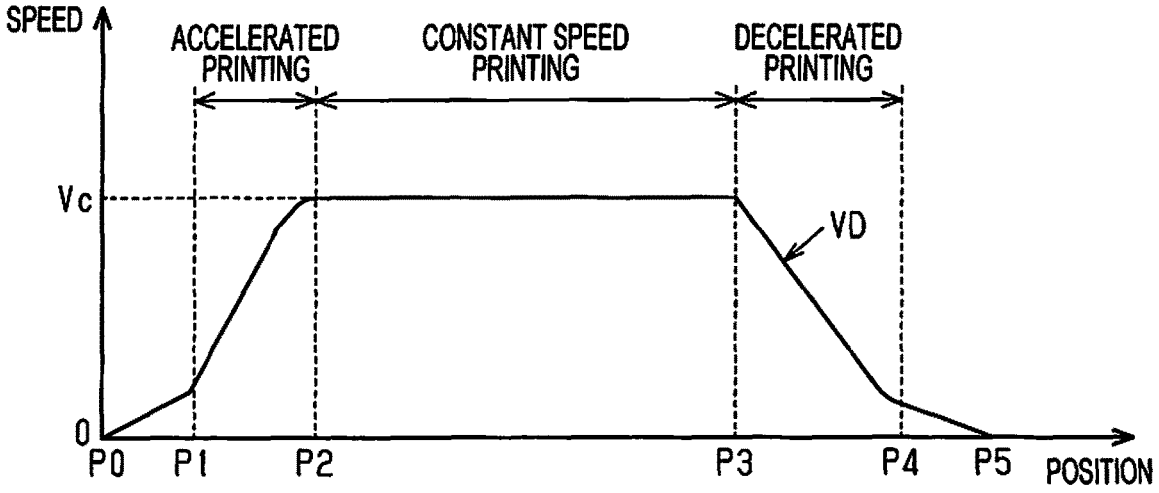
FIG. 7 is a graph that shows speed control profile data of the printing head.

The control section 41 is provided with a Central Processing Unit (CPU) and an Application Specific Integrated Circuit (ASIC), which is a custom LSI, a Read Only Memory (ROM), a Random Access Memory (RAM), and a microcomputer that includes non-volatile memory, and the like (none of these components are illustrated in the drawings). The control section 41 is provided with a head control section 42, a carriage control section 43, and a transport control section 44 composed of software that are constructed when the CPU executes programs stored in the non-volatile memory. In addition, the control section 41 stores speed control profile data VD, which is shown in FIG. 7, in the non-volatile memory. Furthermore, the control section 41 is provided with a control circuit 45, and motor drive circuits 46 and 47. Additionally, in place of software, each control section 42 to 44 may have a configuration that is composed of hardware, or a configuration arising from cooperation of software and hardware.

The head control section 42 sends printing data PD that the printer 11 receives from an external device (a host device), which is not illustrated in the drawings, to the control circuit 45. The control circuit 45 generates character printing control signals Sp that are capable of driving each wire pin 31 (refer to FIG. 4) of the printing head 21 at a character printing timing based on the printing data PD, and outputs the generated character printing control signals Sp to the printing head 21. The control circuit 45 generates and outputs character printing control signals Sp, which define the character printing timing in wire pin units (wire pin group units in the present example) having different positions in the main scanning direction X, to correspond to the wire pins 31 being disposed shifted in three or more (for example, six) different positions in the main scanning direction X.

The carriage control section 43 controls the carriage 17 by driving and controlling the carriage motor 24 via the motor drive circuit 46, and controls a movement operation (a main scan) that causes the printing head 21 to move in the main scanning direction X. The carriage control section 43 controls the speed of the carriage motor 24 on the basis of the speed control profile data VD that is shown in FIG. 7, which is stored in the non-volatile memory. The carriage control section 43 that is shown in FIG. 6 counts the pulses of the rotation detection signal input from the encoder 29 and sequentially acquires the position (carriage position) of the carriage 17 at the time of each pulse. The carriage control section 43 acquires a carriage position (current position) at the time of each pulse using a movement starting position P0 of the carriage 17 as a point of origin, and acquires a target speed corresponding to the current carriage position by referring to the speed control profile data VD on the basis of the carriage position at that time. The carriage control section 43 controls the speed of the carriage 17 to follow the speed control profile data by outputting an instruction value corresponding to a target speed to the motor drive circuit 46. As a result of this, as shown by the graph in FIG. 7, the carriage 17 moves once (makes one scan) in one direction (the forward direction or the reverse direction) by carrying out an acceleration process, a constant speed process, and a deceleration process. Additionally, the carriage control section 43 performs feedback control (for example, PID control) that brings the carriage speed close to the target speed, but, for example, may perform feedforward control for an acceleration region or a deceleration region.

As shown in FIG. 7, the printing head 21 performs accelerated printing, which prints in a segment from a character printing starting position P1 midway through an acceleration process up to an acceleration termination position P2 at which a constant speed Vc is reached, constant speed printing, which prints in a constant speed range that moves at the constant speed Vc, and decelerated printing, which prints in a segment from a deceleration starting position P3 at which deceleration from the constant speed Vc starts up to a character printing termination position P4 midway through a deceleration process. Additionally, in the present embodiment, both accelerated printing and decelerated printing are performed as variable speed printing, but a configuration that uses variable speed printing that uses a variable speed process of at least one of an acceleration process and a deceleration process may also be used.

Figure 6:
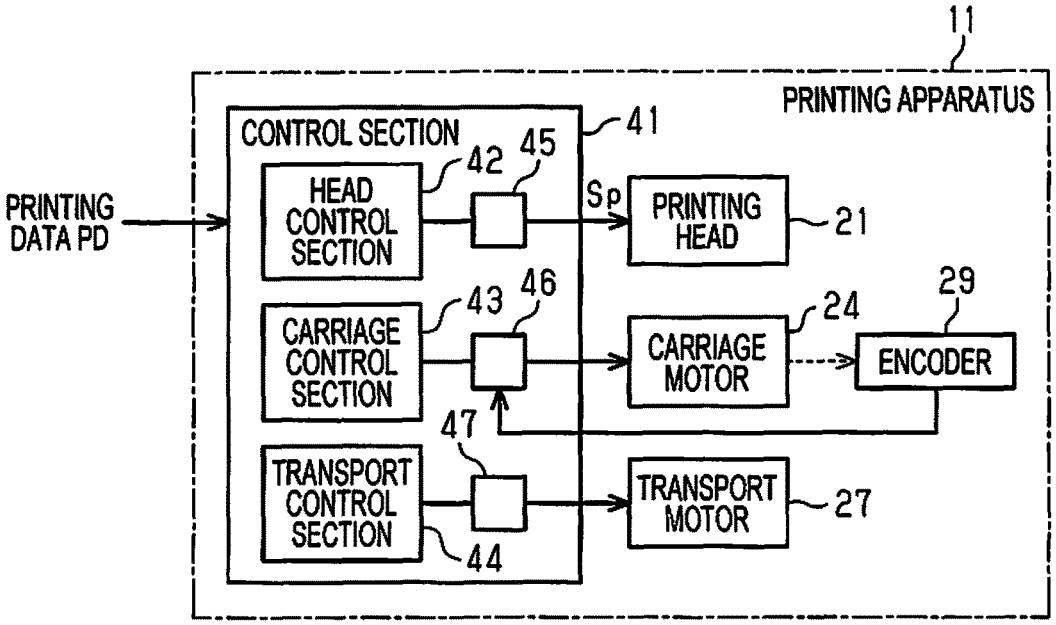
FIG. 6 is a block diagram that shows an electrical configuration of a printing apparatus.

The transport control section 44 that is shown in FIG. 6 transports the medium P up to a target position such as a subsequent character printing position or an ejection position by driving and controlling the transport motor 27 via the motor drive circuit 47 and causing the roller 16 to rotate. During printing, character printing corresponding to one sheet is performed on the medium P by repeating a movement operation (main scan) in which the carriage control section 43 causes the carriage 17 (or in other words, the printing head 21) to move in the main scanning direction X, and a transport operation (sub-scan) in which the transport control section 44 transports the medium P up to a subsequent character printing position.

In addition, the control circuit 45 of the present embodiment generates a character printing control signal Sp that defines the character printing timing of each wire pin 31 on the basis of the printing data PD received from the head control section 42. The control circuit 45 converts the rotation detection signal (encoder signal), which is input from the encoder 29 and includes pulses having a predetermined cycle corresponding to the movement speed (head movement speed) of the printing head 21, into a reference pulse signal that includes pulses having a character printing drive cycle by using a multiplication circuit (not illustrated in the drawings). The control circuit 45 generates a character printing control signal Sp that drives each wire pin on the basis of the reference pulse signal. In the present embodiment, on the surface of the wire guide 22*a*, since the amount of shift Δx (pitch Xp) in the main scanning direction X of the J wire pins 31 that configure a wire pin row 38 is fixed, the character printing control signal Sp of each wire pin 31 is generated by using a latency of a set delay time ΔT (=0, Δt, 2Δt, . . . ) that is delayed by a fixed delay time Δt relative to the reference pulse signal. The fixed delayed time Δt is a value that changes depending on the head scanning speed at that time. Additionally, among the J wire pins 31, a wire pin 31 that is positioned at the beginning in the traveling direction of the printing head 21 is defined as a reference wire pin. In addition, the character printing control signal Sp is a pulse signal in which the emergence period of the pulses is equal to an energization period of the coil 32, and which defines the driving period of a wire pin 31.

In addition, the control circuit 45 is equipped with a plurality of switching elements (not illustrated in the drawings) that correspond to the plurality of wire pins 31. The control circuit 45 turns ON a switching element that corresponds to a given wire pin 31 when a dot value (pixel value) that corresponds to the wire pin 31 is "1" in the received printing data PD, and keeps a switching element that corresponds to a given wire pin 31 OFF when a dot value that corresponds to the wire pin 31 is "0". A period in which a switching element is turned on once is slightly longer than a maximum value of the set delay time ΔT, a character printing control signal Sp is output when a switching element is ON, and a character printing control signal Sp is not output when a switching element is OFF.

For example, the control circuit 45 is equipped with a delay counter (not illustrated in the drawings). The delay counter counts the set delay time ΔT by counting the number of pulses of the pulse signal input from a clock circuit, which is not illustrated in the drawings, from a point in time at which a reference pulse signal St is input. When a count value of the delay counter reaches a value that is equivalent to the set delay time ΔT, the control circuit 45 outputs a character printing control signal Sp that drives a corresponding wire pin 31 by outputting the reference pulse signal St delayed by an amount corresponding to the set delay time ΔT after the input of the reference pulse signal St.

Next, actions of the printing head 21 and the printer 11 that are configuration in the above-mentioned manner will be described. A plurality of character strings are character printed on the medium P based on the printing data PD by repeatedly performing movement (a character printing operation) of the printing head 21 in the main scanning direction X and a transport operation of the medium P in the sub-scanning direction Y. As a result of speed of the carriage motor 24 being controlled on the basis of the speed control profile data VD, the speed of the printing head 21 is controlled to follow the speed profile that is shown in FIG. 7. That is, as shown in FIG. 7, the printing head 21 accelerates from the movement starting position P0, and performs accelerated printing in a segment from the character printing starting position P1 midway through the acceleration process up to the acceleration termination position P2. Further, the printing head 21 performs constant speed printing in a constant speed region from the acceleration termination position P2 up to the deceleration starting position P3. Furthermore, the printing head 21 performs decelerated printing in a segment from the deceleration starting position P3 up to the character printing termination position P4 of the deceleration process. When the decelerated printing is finished, the printing head 21 stops at a stopping position P5 after decelerating.

For example, in a case in which accelerated printing and decelerated printing are performed by using a printing head that has the annular type wire arrangement disclosed in JP-A-5-24213, the scanning speed of the printing head changes when the reference wire pin, which is positioned at the beginning in the traveling direction of the printing head, character prints, and when a wire pin that is positioned at the end in the traveling direction character prints. That is, the printing head accelerates and the head scanning speed changes from a time at which the reference wire pin at the beginning prints a character up to a time at which the character printing timing of a wire pin, which is most distant in the main scanning direction from the reference wire pin and is positioned at the end in the traveling direction, is reached. In this case, the change in the head scanning speed increases as the distance in the main scanning direction from the reference wire pin at the beginning in the printing head up to the wire pin at the end increases. Therefore, in a printing head that has an annular type wire arrangement in which the distance between the wire pins of the beginning and the end is comparatively long, even if a set delay time ΔT corresponding to the distance between the wire pins of the beginning and the end is set and character printing control signals are output, the character printing position (dot printing position) of the wire pin at the end is shifted in the main scanning direction from the regular printing position at which character printing should be performed. In this case, character printing shift in the main scanning direction X between the reference wire pin and the wire pin at the end is significant.

In the present embodiment, the J (for example, 12) wire pins 31 that configure a wire pin row 38 are arranged shifted in three or more different positions in the main scanning direction X within a range (ΔX max≤Yp) in which the maximum amount of shift ΔX max in the main scanning direction X is equal to the dimension of the pitch Yp in the sub-scanning direction Y of the wire pin 31 or less. Therefore, the center distance (maximum amount of shift ΔX max) in the main scanning direction X of the wire pin 31 at the end, which is positioned furthest in the main scanning direction X from the reference wire pin, which is positioned at the beginning in the traveling direction of the printing head 21, is comparatively short, namely, the pitch Yp or less. Accordingly, a change in the scanning speed of the printing head 21 between times at which the reference wire pin at the beginning in the head traveling direction and the wire pin at the end print a character is comparatively small. Therefore, the amount of character printing shift (amount of dot shift) in the main scanning direction X between the reference wire pin at the beginning and the wire pin at the end is restricted. Accordingly, it is also unlikely that character printing shift will occur during variable speed printing.

In addition, since the wire pin rows 38 are provided in the printing head 21 in two two-row sets (corresponding to two characters) of rows A and B and rows C and D, which are used in character printing one character at a time, the printing speed is improved in comparison with a configuration in which the wire pin rows are provided in a single set. In this manner, as a result of the improvement in printing speed, even if the scanning speed of the printing head 21 increases, it is possible to restrict character printing shift between the reference wire pin and the wire pin at the end in a relative manner to an extent corresponding to the improvement.

In addition, when the printing head has a configuration having a wire pin row in which a plurality of wire pins are provided so as to extend straight along the sub-scanning direction, for example, when character printing a character (for example, an "I") that includes a vertical line that extends in the sub-scanning direction, or the like, the implemented frequency of simultaneous impact character printing, in which the plurality of wire pins are driven simultaneously, is increased, and therefore, there is an increase in noise. In addition, when the plurality of wire pins are driven simultaneously, there is a relative increase in the maximum power consumption of the printer including the power consumption of other electrical components, and therefore, there are cases in which a large power supply device is required in order to accommodate the maximum power consumption in a range of the rated value thereof or less.

For this reason, in the printing head 21 of the present embodiment, the J wire pins 31 that configure a wire pin row 38 are disposed shifted in the main scanning direction X in three or more different positions (in particular, six different positions) within a range in which the maximum amount of shift ΔX max is equal to the same dimension as the pitch Yp in the sub-scanning direction Y. For example, even in a case in which the printing head 21 prints a character that includes a vertical line, the number of wire pins 31 that are driven simultaneously is reduced, and the implemented frequency of dispersed impact character printing is relatively high. Accordingly, a low-noise effect is obtained when the printing head 21 prints a character. Moreover, since the frequency with which the plurality of wire pins 31 are driven simultaneously is relatively low, the maximum power consumption of the printer 11 including the power consumption of other electrical components such as the motors 24 and 27 is restricted in a relative manner, and therefore, a power supply device for accommodating the maximum power consumption in a range of the rated value thereof or less can be small.

According to the abovementioned embodiment, it is possible to obtain the following effects.

(1) The dot impact printing head 21 is provided with at least one wire pin row 38 formed as a result of a plurality of wire pins being arranged at a fixed pitch in the sub-scanning direction Y. All of the wire pins 31 that configure a wire pin row 38 are disposed shifted in the main scanning direction X in three or more different positions within a range of the same dimension as the pitch Yp in the sub-scanning direction Y. Accordingly, since all of the wire pins 31 that configure a wire pin row 38 are disposed shifted in three or more different positions in the main scanning direction X, it is likely that the impact periods of the wire pins 31 will be shifted when character printing, the implemented frequency of dispersed impact character printing is relatively high, and therefore, it is possible to obtain a low-noise effect. Moreover, in variable speed printing (accelerated printing and decelerated printing), which prints by using the acceleration process and the deceleration process in processes in which the printing head 21 moves in the main scanning direction X, it is possible to restrict the amount of character printing shift (amount of dot shift), in the main scanning direction X, between wire pins 31 and 31 having different positions in the main scanning direction X. Accordingly, it is possible to obtain a low-noise effect during printing and a suppressing effect of character printing shift (dot shift) between wire pins 31 and 31 in variable speed printing.

(2) The number of different positions in the main scanning direction X of the wire pins 31 that configure a wire pin row 38 is less than the number of wire pins J that configure the wire pin row 38. Accordingly, in comparison with a configuration in which all of the wire pins 31 that configure a wire pin row 38 are shifted in the main scanning direction X in wire pin units, it is possible to dispose the wire pins 31 in a dispersed manner leaving a broad center line interval in the main scanning direction X in proportion to the breadth of a range (the range of the maximum amount of shift ΔX max) within which all of the wire pins 31 are kept in the main scanning direction X. Accordingly, it is possible to realize a decrease in noise during wire pin driving and high printing quality during variable speed printing. In addition, since it is possible to dispose the plurality of wire pins 31 in a dispersed manner in three or more different positions in the main scanning direction X, the maximum power consumption that accompanies driving of the wire pins 31 during printing is decreased, and it is possible to avoid an increase in the size of a power supply device.

(3) The J (J is a natural number of four or more) wire pins 31 that configure a wire pin row 38 are divided into N (where N is a natural number satisfying $N \leq J/2$) wire pin groups 39 in the sub-scanning direction Y, a plurality of (M) wire pins 31 that configure a wire pin group 39 have the same positions in the main scanning direction X. Accordingly, since the wire pins 31 are shifted in positions in the main scanning direction X in wire pin group 39 units, in comparison with a configuration of being shifted in the main scanning direction X in wire pin units, it is possible to ensure a relatively broad center line interval of the wire pins 31, that is, pitch Xp in the main scanning direction X, in proportion to the breadth of a range within which all (J) of the wire pins 31 are kept in the main scanning direction X. Accordingly, it is possible to obtain an improved low-noise effect during wire pin driving and a suppressing effect of character printing shift during variable speed printing.

(4) A plurality (N) of the wire pin groups 39 is disposed in a zigzag shape. Accordingly, it is possible to dispose the wire pins 31 in a dispersed manner while ensuring a broad center line interval in the main scanning direction X in proportion to the extent to which the range within which all of the wire pins 31 are kept in the main scanning direction X is relatively restricted. In addition, in a printing head in which all of the wire pins are arranged in an oblique manner along a direction that intersects the main scanning direction X and the sub-scanning direction Y in an oblique manner, for example, in a case of character printing a character including an oblique line in which dots are aligned in an oblique manner, the implemented frequency of simultaneous impact character printing is increased. In contrast to this, since all (J) of the wire pins 31 are arranged in a zigzag shape, the implemented frequency of dispersed impact is also relatively high in a case of character printing a character including such oblique lines. Accordingly, it is possible to more effectively obtain a low-noise effect during printing and a high printing quality by using variable speed printing.

(5) The plurality of wire pins 31 that configure a wire pin row 38 are disposed at a fixed pitch in the main scanning direction X. When the dot impact printing head 21 moves in the main scanning direction X, among the plurality of wire pins 31 that configure the wire pin row 38, the control section 41 determines the character printing timings of other wire pins 31 having different positions in the main scanning direction X on the basis of the character printing timing of a wire pin 31 that is positioned at the beginning in the head traveling direction. In this case, since it is sufficient as long as the character printing control signals Sp that correspond to each wire pin 31 are each shifted by the fixed delay time Δt, character printing timing control by the control section 41 is comparatively simple.

(6) The printer 11 performs constant speed printing that uses a constant speed process of the printing head 21, and variable speed printing that uses a variable speed process including at least one of an acceleration process and a deceleration process of the printing head 21. Accordingly, it is possible to restrict the amount of positional shift in the main scanning direction X of printed dots between wire pins 31 and 31 having different positions in the main scanning direction X during variable speed printing.

(7) The printer 11 is provided with the dot impact printing head 21, the main scanning section 23 that causes the printing head 21 to move in the main scanning direction X, and the sub-scanning section 28 that transports, in the sub-scanning direction Y, the medium P that is the subject of printing by the printing head 21. Accordingly, since the printer 11 is provided with the dot impact printing head 21, it is possible to obtain a low-noise effect during printing and a suppressing effect of character printing shift during variable speed printing.

The above-mentioned embodiment may have the modification examples shown below. In addition, the configurations included in the above-mentioned embodiment and the configurations included in the following modification examples may be arbitrarily combined, and the configurations included in the following modification examples may be arbitrarily combined with one another.

Figure 8:
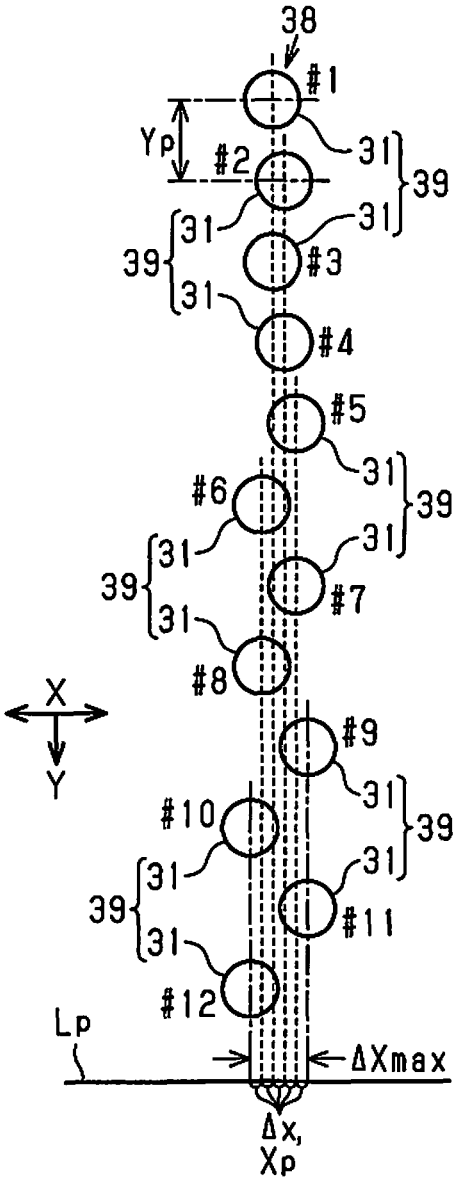
FIG. 8 is a front view that describes features of a wire pin row in a modification example.

As shown in FIG. 8, the M (for example, two) wire pins 31 that belong to a wire pin group 39 that configures a wire pin row 38 may be wire pins that are not continuous in the sub-scanning direction Y. For example, as shown in FIG. 8, the M wire pins 31 that belong to a wire pin group 39 may be each second wire pin in the sub-scanning direction Y. In this case, as shown in FIG. 8, it is preferable that the wire pin groups 39 be disposed in a zigzag shape. Additionally, the M wire pins 31 that belong to a wire pin group 39 may be each third wire pin.

Figure 9:
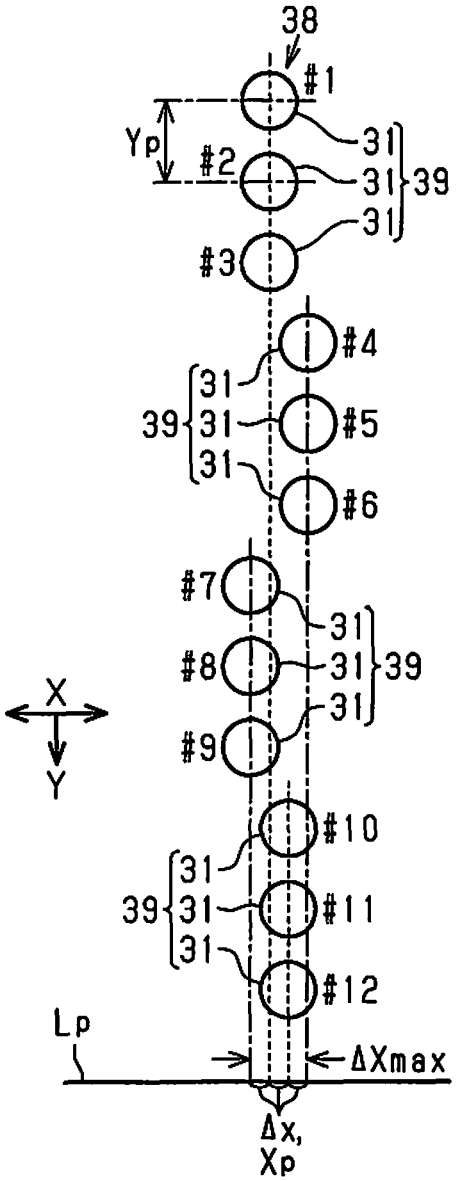
FIG. 9 is a front view that describes features of a wire pin row in a different modification example from FIG. 8.

As shown in FIG. 9, the number of the M wire pins that belong to a wire pin group 39 that configures a wire pin row 38 may be three. In this case, as shown in FIG. 9, it is preferable that the wire pin groups 39 that includes three wire pins 31 be disposed in a zigzag shape. Additionally, the three wire pins 31 that belong to a wire pin group 39 are not limited to being three pins that are continuous in the sub-scanning direction Y as shown in FIG. 9, and at least one among the three may be each second or each third pin.

Figure 10:
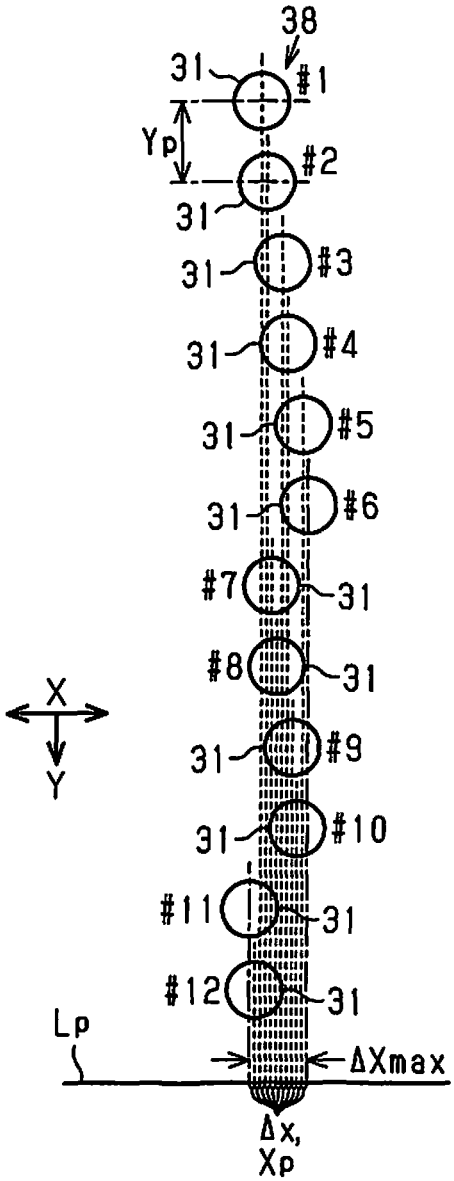
FIG. 10 is a front view that describes features of a wire pin row in a different modification example from FIG. 9.

The wire pin groups 39, which are collections of a plurality of wire pins 31 having the same position in the main scanning direction X, may be omitted. As shown in FIG. 10, a configuration in which a wire pin row 38 does not include wire pin groups and the plurality of (J) wire pins 31 that configure a wire pin row 38 may be disposed shifted in J different positions within a range of the same dimension as the pitch Yp in the sub-scanning direction Y with the fixed amount of shift Δx, may also be used. Additionally, as shown in FIG. 10, it is preferable that all of the wire pins 31 that configure a wire pin row 38 be disposed in a zigzag shape.

It is sufficient as long as the maximum amount of shift ΔX max is the pitch Yp in the sub-scanning direction Y of all of the wire pins that configure a wire pin row or less. In addition, the maximum amount of shift ΔX max may be defined as the diameter of the wire pins 31 or less. Furthermore, the maximum amount of shift ΔX max was defined as the diameter of the wire pins 31 or more, but is preferably the radius of the wire pins 31 or more.

The number N of the wire pin groups 39 that configure a wire pin row 38, that is, the number of divisions N of the plurality of wire pins that configure a wire pin row, is not limited to six, and may be altered to be an appropriate number. For example, in a case in which the number of wire pins that configure a wire pin row is 12, N may be three or four. In this case, the number M of wire pins 31 that belong to a wire pin group 39 is four in a case in which N=3 and is three in a case in which N=4. In addition, for example, in a case in which the number of wire pins that configure a wire pin row is 9, N may be three. In this case, the number M of wire pins 31 that belong to a wire pin group 39 is three.

The number J of wire pins that configure a wire pin row may be a number other than 9 or 12. For example, it is sufficient as long as the number J of wire pins is a natural number of four or more. In addition, it is sufficient as long as the number N (number of divisions) of wire pin groups that configure a single wire pin row is a natural number satisfying $N \leq J/2$.

All of the wire pins that configure a wire pin row are not limited to being disposed in a zigzag shape, and it is sufficient as long as the wire pins are shifted in at least three different positions in the main scanning direction X.

The pitch Xp (the amount of shift Δx) in the main scanning direction X of the wire pins 31 that configure a wire pin row 38 may differ between different wire pins 31.

The number of wire pin rows 38 is not limited to four, and may be altered to an appropriate number. For example, in an example in which the number J of wire pins that configure a wire pin row 38 is 12×2 rows for kanji character printing, the number of wire pin rows may be two. In addition, for example, in an example in which the number J of wire pins that configure a wire pin row is 9×1 row alphabet character printing, the number of wire pin rows can be selected from an arbitrary number from one to four, and for example, may be three.

It is sufficient as long as the variable speed printing uses at least one of accelerated printing and decelerated printing. For example, a configuration that performs either one of accelerated printing and decelerated printing only may also be used.

The printing apparatus is not limited to a serial printing system, and may be a lateral printing system in which the printing head 21 is capable of moving in two directions of the main scanning direction and the sub-scanning direction.

What is claimed is:

1. A dot impact printing head for a printing apparatus that performs printing on a medium by repeating transport of the medium in a sub-scanning direction and movement of the dot impact printing head in a main scanning direction that intersects the sub-scanning direction, the dot impact printing head comprising:

at least one wire pin row formed by a plurality of wire pins being arranged at a fixed pitch in the sub-scanning direction, all of the wire pins that form the wire pin row being shifted from each other in three or more different positions in the main scanning direction, with the all of the wire pins being disposed within a range that is smaller than or equal to the fixed pitch, the three or more different positions being disposed at equally spaced intervals in the main scanning direction.

2. The dot impact printing head according to claim 1, wherein the number of the three or more different positions is less than the number of wire pins that configure the wire pin row.

3. The dot impact printing head according to claim 1, wherein J (where J is a natural number of six or more) wire pins that configure the wire pin row include N (where N is a natural number satisfying $3 \leq N \leq J/2$) wire pin groups in the sub-scanning direction, and M (where M is a natural number satisfying $2 \leq M \leq J-4$) wire pins that belong to the wire pin groups are disposed in the same positions in the main scanning direction.

4. The dot impact printing head according to claim 3, wherein a plurality of the wire pin groups are disposed in a zigzag shape.

5. The dot impact printing head according to claim 1, wherein the printing apparatus performs constant speed printing that uses a constant speed process of the dot impact printing head, and variable speed printing that uses a variable speed process including at least one of an acceleration process and a deceleration process of the dot impact printing head.

6. The dot impact printing head according to claim 1, wherein all of the wire pins that form the wire pin row are grouped into four or more wire pin groups that are shifted from each other in four or more different positions, respectively, in the main scanning direction, with the four or more wire pin groups are disposed in a zigzag shape.

7. A printing apparatus comprising:

the dot impact printing head according to claim 1;

a main scanning section that causes the dot impact printing head to move in the main scanning direction; and a sub-scanning section that transports, in the sub-scanning direction, a medium that is the subject of printing of the dot impact printing head.

8. A printing apparatus comprising:

the dot impact printing head according to claim 2;

a main scanning section that causes the dot impact printing head to move in the main scanning direction; and a sub-scanning section that transports, in the sub-scanning direction, a medium that is the subject of printing of the dot impact printing head.

9. A printing apparatus comprising:

the dot impact printing head according to claim 3;

a main scanning section that causes the dot impact printing head to move in the main scanning direction; and a sub-scanning section that transports, in the sub-scanning direction, a medium that is the subject of printing of the dot impact printing head.

10. A printing apparatus comprising:

the dot impact printing head according to claim 4;

a main scanning section that causes the dot impact printing head to move in the main scanning direction; and a sub-scanning section that transports, in the sub-scanning direction, a medium that is the subject of printing of the dot impact printing head.

11. A printing apparatus comprising:

the dot impact printing head according to claim 6;

a main scanning section that causes the dot impact printing head to move in the main scanning direction; and a sub-scanning section that transports, in the sub-scanning direction, a medium that is the subject of printing of the dot impact printing head.

12. A printing apparatus comprising:

the dot impact printing head according to claim 5;

a main scanning section that causes the dot impact printing head to move in the main scanning direction; and a sub-scanning section that transports, in the sub-scanning direction, a medium that is the subject of printing of the dot impact printing head.

* * * * *